US008806748B2

(12) United States Patent
Huang

(10) Patent No.: US 8,806,748 B2
(45) **Date of Patent: *Aug. 19, 2014**

(54) HEAT PIPE MOUNTING METHOD

(76) Inventor: Tsung-Hsien Huang, I-Lan Hsien (TW)

( * ) Notice: Subject to any disclaimer, the term of this patent is extended or adjusted under 35 U.S.C. 154(b) by 455 days.

This patent is subject to a terminal disclaimer.

(21) Appl. No.: 13/178,489

(22) Filed: Jul. 7, 2011

(65) Prior Publication Data

US 2012/0222840 A1 Sep. 6, 2012

(30) Foreign Application Priority Data

Mar. 4, 2011 (CN) ..... 2011 1 0052053

(51) Int. Cl.

| | |
|---|---|
| ***B23P 15/26*** | (2006.01) |
| ***B21D 53/08*** | (2006.01) |
| ***B23P 19/02*** | (2006.01) |
| ***F28D 15/02*** | (2006.01) |
| ***F28F 9/013*** | (2006.01) |

(52) U.S. Cl.

CPC ..... *F28F 9/013* (2013.01); *F28D 15/0275* (2013.01); *F28D 15/02* (2013.01)

USPC ..... 29/890.032; 29/890.038; 29/890.045; 29/505; 29/525; 29/437

(58) Field of Classification Search

CPC ..... H01L 23/427; H01L 23/46; H01L 23/467; H01L 23/473; H01L 23/40; F28D 15/0275; B23P 15/26; B23P 11/00; B23P 11/02; B21D 53/08; B21D 39/048

USPC ..... 29/890.032, 890.03, 890.035, 890.038, 29/890.04, 890.041, 890.045, 890.06, 29/890.07, 525, 445, 446, 505, 506, 508, 29/437; 165/171, 172, 104.26, 104.33, 165/80.2, 80.5, 80.3

See application file for complete search history.

(56) References Cited

U.S. PATENT DOCUMENTS

| | | | | |
|---|---|---|---|---|
| 7,441,592 | B2 * | 10/2008 | Huang | 165/104.33 |
| 2009/0084528 | A1 * | 4/2009 | Cheng et al. | 165/104.33 |
| 2009/0178787 | A1 * | 7/2009 | Huang | 165/104.33 |
| 2010/0270007 | A1 * | 10/2010 | Lin | 165/80.2 |

* cited by examiner

*Primary Examiner* — Sarang Afzali

(74) *Attorney, Agent, or Firm* — Pai Patent & Trademark Law Firm; Chao-Chang David Pai

(57) ABSTRACT

A heat pipe mounting method and a heat pipe assembly thereof are disclosed. The method includes the step of providing a heat-transfer block and a plurality of heat pipes. A plurality of heat pipe grooves is formed on the heat-transfer block. The heat pipes are then press-fitted to respective heat pipe grooves. During the press-fitting step, the heat pipes are flattened to force the flattened part of one heat pipe into abutment against the flattened part of another heat pipe in a flushed manner. Thereby, the heat pipes are abutted to each other with no separation therebetween. Hence, the heat transfer performance is increased.

4 Claims, 6 Drawing Sheets

HEAT PIPE MOUNTING METHOD

BACKGROUND OF THE INVENTION (a) Field of the Invention

The instant disclosure relates to a heat transfer technology; more particularly, to a heat pipe mounting method and a heat pipe assembly thereof.

(b) Description of the Prior Art

A heat-transfer block is often used with heat pipes to enhance heat transfer performance. To accommodate the heat pipes, the heat-transfer block is often provided with heat pipe grooves. These heat pipe grooves are spaced from one another by certain distance, i.e., the heat pipes cannot be closely arranged together. Thus, the number of heat pipes allowed for the heat-transfer block is restricted. In addition, the heat transfer among the heat pipes is unsatisfactory. Namely, the outer heat pipes are farther away from the heat source, thus the heat transfer performance is less effective. Because the heat pipes are spaced apart from one another, the inner heat pipes cannot transfer heat directly to the outer heat pipes.

Furthermore, when securing heat pipes to respective heat pipe grooves of the heat-transfer block, a soldering material is often employed. Alternatively, solder-less press-fit method may be employed to affix heat pipes to respective heat pipe grooves of the heat-transfer block. These heat pipe grooves may be configured to provide arched or oval cross sections. When the heat pipes are forced into respective heat pipe grooves, the heat pipes are pressed fitted to prevent accidental separation. However, because the heat pipe grooves have arched or oval cross sections, the heat pipes tend to be loosened or forced out of position accidentally in absence of the soldering or adhesive materials. Further, for more than one heat pipe, the oval-shaped heat pipe grooves force these heat pipes to be spaced further apart from one another. Due to such limitation, the heat pipes cannot be closely arranged. On the other hand, if the soldering material or paste is opted to secure the heat pipes, the following issues may occur. If not enough soldering material or paste is available, the heat pipes may be loosely attached. However, if too much soldering material or paste is applied, the excessive amount would overflow the grooves as an eyesore to the users. Other disadvantages include the increase in material and manufacturing costs.

To address the above issues, the inventor strives via industrial experience and academic research to develop the instant disclosure, which can effectively improve the limitations as described above.

SUMMARY OF THE INVENTION

One aspect of the instant disclosure is to provide a heat pipe mounting method and a heat pipe assembly thereof. When multiple heat pipes are disposed on a heat-transfer block, the heat pipes are arranged next to each other without separation. Thus, the heat transfer performance can be enhanced.

Another aspect of the instant disclosure is to provide a heat pipe mounting method and a heat pipe assembly thereof, which employs a solder-less press-fit method to firmly secure the heat pipes to respective heat pipe grooves of the heat-transfer block, avoiding displacement of the heat pipes. This method is applicable to the semi-circular shaped heat pipe grooves for grouping the heat pipes effectively.

To achieve the above objectives, the heat pipe mounting method of the instant disclosure includes the following steps: a) providing a heat-transfer block and a plurality of heat pipes, wherein the heat-transfer block has a plurality of heat pipe grooves formed thereon, and a supporting rib is formed between each heat pipe groove, wherein a tip portion is defined on each supporting rib; b) press-fitting the heat pipes into respective heat pipe grooves; and c) flattening the heat pipes to force the flattened part of one heat pipe into abutment against the flattened part of the other heat pipe when press-fitting the heat pipes into the heat pipe grooves, wherein the heat pipes abut to one another without separation.

The heat-transfer block has a surface, wherein a plurality of heat pipe grooves are orderly formed thereon in close proximity, and a supporting rib is formed between each heat pipe groove, wherein a tip portion is defined on each supporting rib. The heat pipes are press-fitted into respective heat pipe grooves. An abutting portion is formed on each heat pipe along the tip portion of the supporting rib. The abutting portion of each heat pipe is flushed with the abutting portion of the adjacent heat pipe.

DETAILED DESCRIPTION OF THE PREFERRED EMBODIMENTS

The various objects and advantages of the instant disclosure will be more readily understood from the following detailed descriptions when read in conjunction with the appended drawings. However, the appended drawings are for references and explanation purposes only, therefore are not used to restrict the scope of the instant disclosure.

Figure 1:
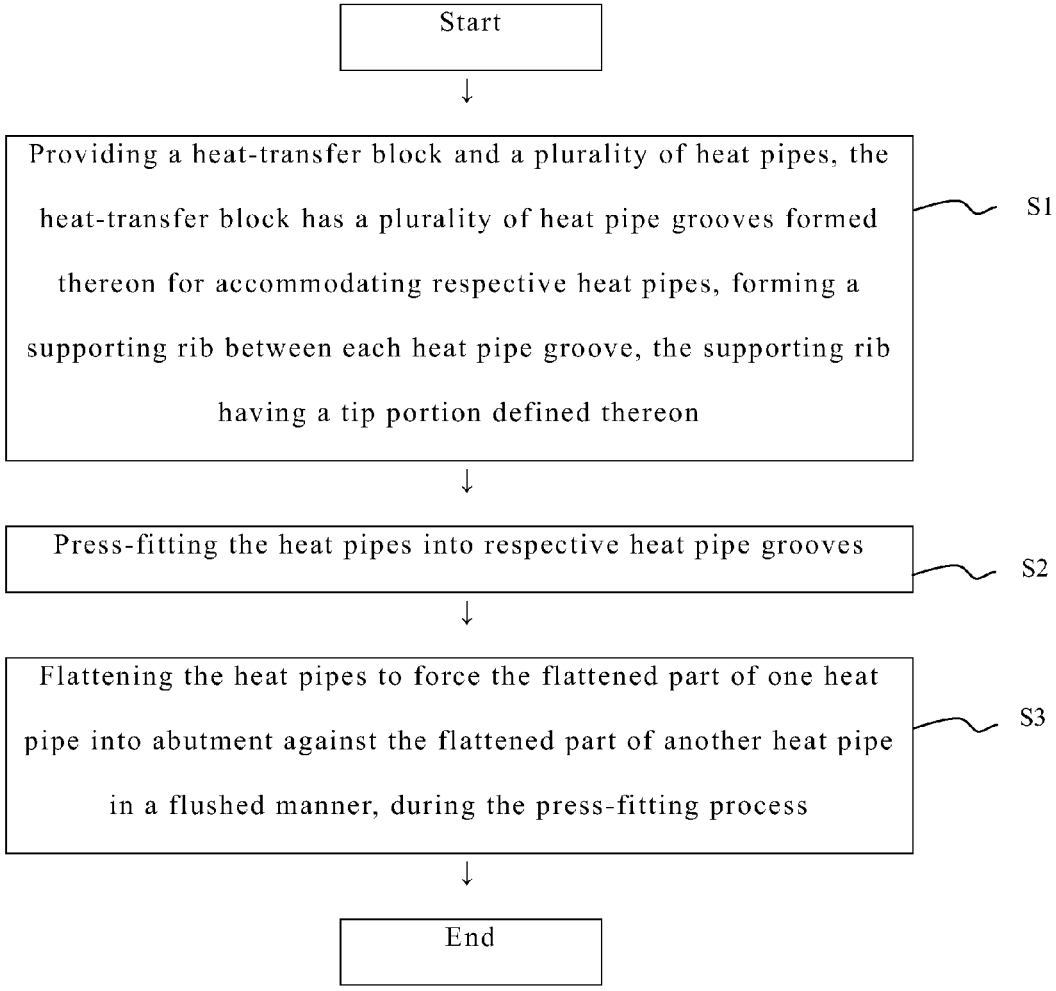
FIG. 1 is a flow chart illustrating the steps of a heat pipe mounting method onto a heat-transfer block according to the instant disclosure.
Figure 2:
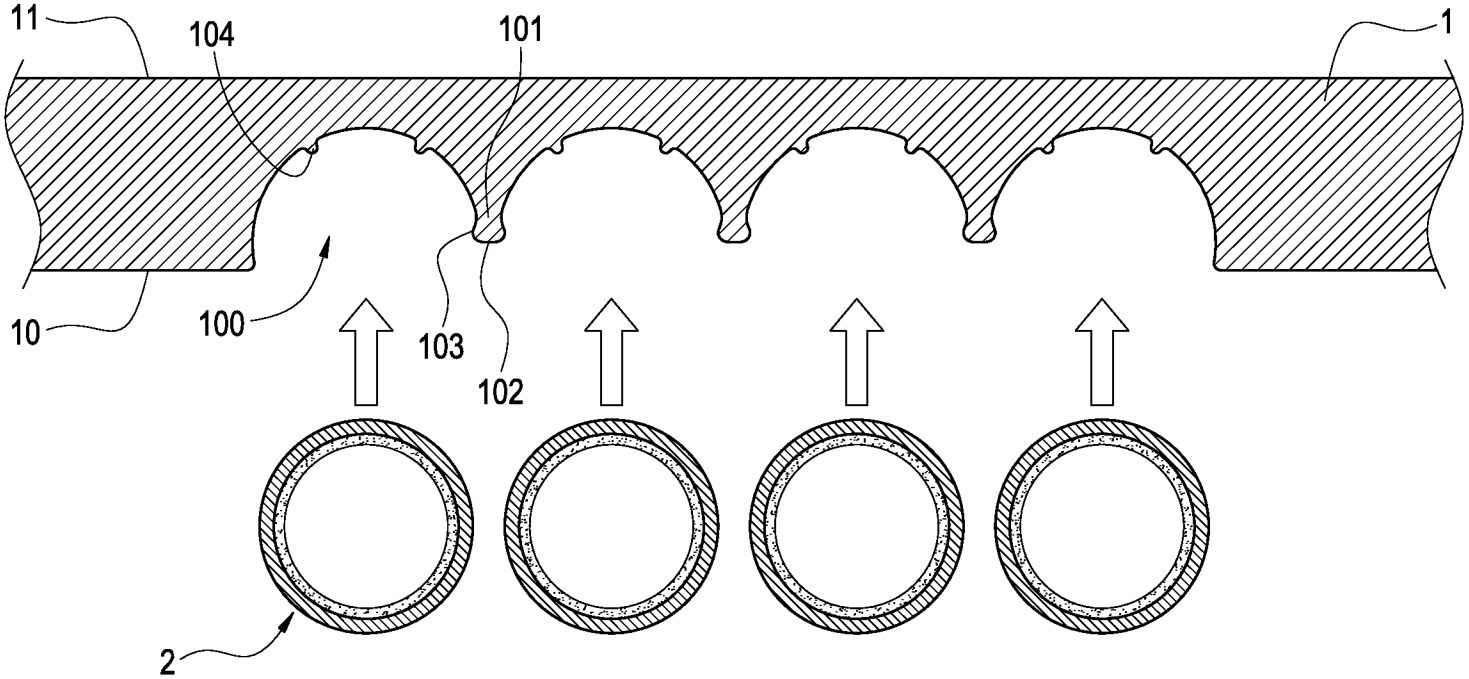
FIG. 2 is a schematic view illustrating a step S1 of FIG. 1.

The instant disclosure provides a heat pipe mounting method and a heat pipe assembly thereof. Please refer to FIG. 1, which shows the heat pipe mounting method having the following steps:

For step S1, please refer to FIG. 2 in conjunction with FIG. 1. In step S1, a heat-transfer block 1 and a plurality of heat pipes 2 are first provided. The heat-transfer block 1 can be made of copper, aluminum, or any other material having good thermal conductivity. The heat-transfer block 1 may be used as a base of a heat sink for affixing to a heat source. In particular, the heat-transfer block 1 has at least one bottom surface 10 for affixing to the heat source. For the instant embodiment, a plurality of heat pipe grooves 100 are formed on the bottom surface 10 of the heat-transfer block 1 to accommodate the heat pipes 2. It is to be understood that the arrangement of the heat pipe grooves 100 on the contacting surface 10 is simply an example but not intended as a limitation. In actual practice, the heat pipe grooves 100 may be arranged on any other side of the heat-transfer block 1. The cross section of each heat pipe groove 100 is arched in such a way of being approximately larger than a semi-circle. The number of heat pipe grooves 100 is equivalent to the number of the heat pipes 2. Also, the heat pipe grooves 100 are arranged orderly in close proximity. A supporting rib 101 is formed between each heat pipe groove 100. A tip portion 102 is defined on each supporting rib 101 thereon. The tip portions 102 are short of reaching coplanarly with the bottom surface 10, i.e., the tip portions 102 are not leveled with the contacting surface 10 and do not extend beyond the contacting surface 10.

Figure 3:
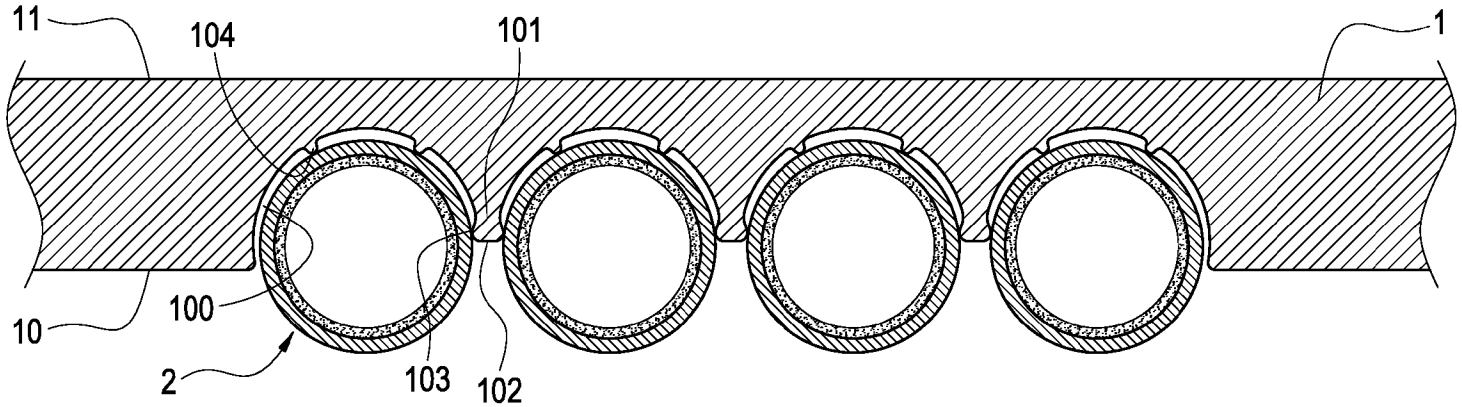
FIG. 3 is a schematic view illustrating a step S2 of FIG. 1.

Referring to FIG. 3 along with FIG. 1, wherein for step S2, the heat pipes 2 are press-fitted into respective heat pipe grooves 100.

Figure 4:
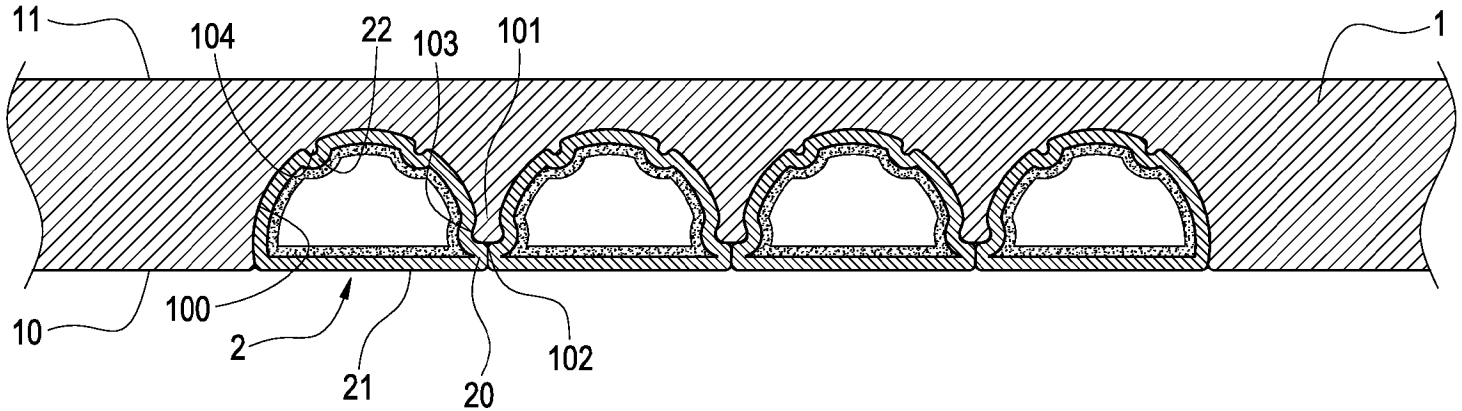
FIG. 4 is a schematic view illustrating a step S3 of FIG. 1.

For step S3, please refer to FIG. 4 in conjunction with FIG. 1. When the heat pipes 2 are forced into respective heat pipe grooves 100, the heat pipes 2 are flattened by means of a press or any tool means (not shown), such that a portion of each heat pipe 2 extends toward adjacent heat pipes 2. For the instant embodiment, the tip portion 102 of each supporting rib 101 between each heat pipe groove 100 is short of reaching coplanarly with the contacting surface 10. Therefore, when the heat pipes 2 are forced into the heat pipe grooves 100, an abutting portion 20 is formed along the tip portion 102 of the supporting rib 101 as each heat pipe 2 is flattened. The abutting portion 20 of each heat pipe 2 is flushed with the abutting portion 20 of the adjacent heat pipe 2, i.e., the abutting portions 20 between each heat pipe 2 cover the corresponding tip portion 102 of the supporting rib 101. The flushed arrangement of the abutting portions 20 between each heat pipe 2 allow the heat pipes 2 to be tightly secured to respective heat pipe grooves 100.

Please refer to FIGS. 2~4 again. For step S1, each supporting rib 101 can be formed having a rounded protrusion 103 toward one of the adjacent heat pipe groove 100 or for each adjacent heat pipe groove 100. When the heat pipes 2 are forced into respective heat pipe grooves 100, the protrusions 103 of the supporting ribs 101 are forced into engagement with the periphery of respective heat pipes 2, prohibiting displacement of the heat pipes 2 from the respective heat pipe grooves 100. Furthermore, each heat pipe groove 100 can further has at least one fixing rib 104 formed thereon. When the heat pipes 2 are forced into the respective heat pipe grooves 100 in step S2, the fixing rib 104 is forced to abut and impress into the corresponding heat pipe 2, thus forming an impression 22 thereon. By virtue of the fixing rib 104, the original contact area of each arched heat pipe groove 100 is no longer rounded, which also prevents the displacement or loosening of the heat pipes 2 from the heat pipe grooves 100. When the soldering material is not being used, the fixing ribs 104 allow the heat pipes 2 to be disposed directly onto the heat-transfer block 1 securely in a solder-less press-fit manner.

Please refer to FIGS. 3 and 4 again. The exposed portion of each heat pipe 2 is flattened in forming a heat-absorbing surface 21. The heat-absorbing surfaces 21 can be formed coplanarly with the bottom surface 10 of the heat-transfer block 1 to contact the heat source smoothly.

Figure 5:
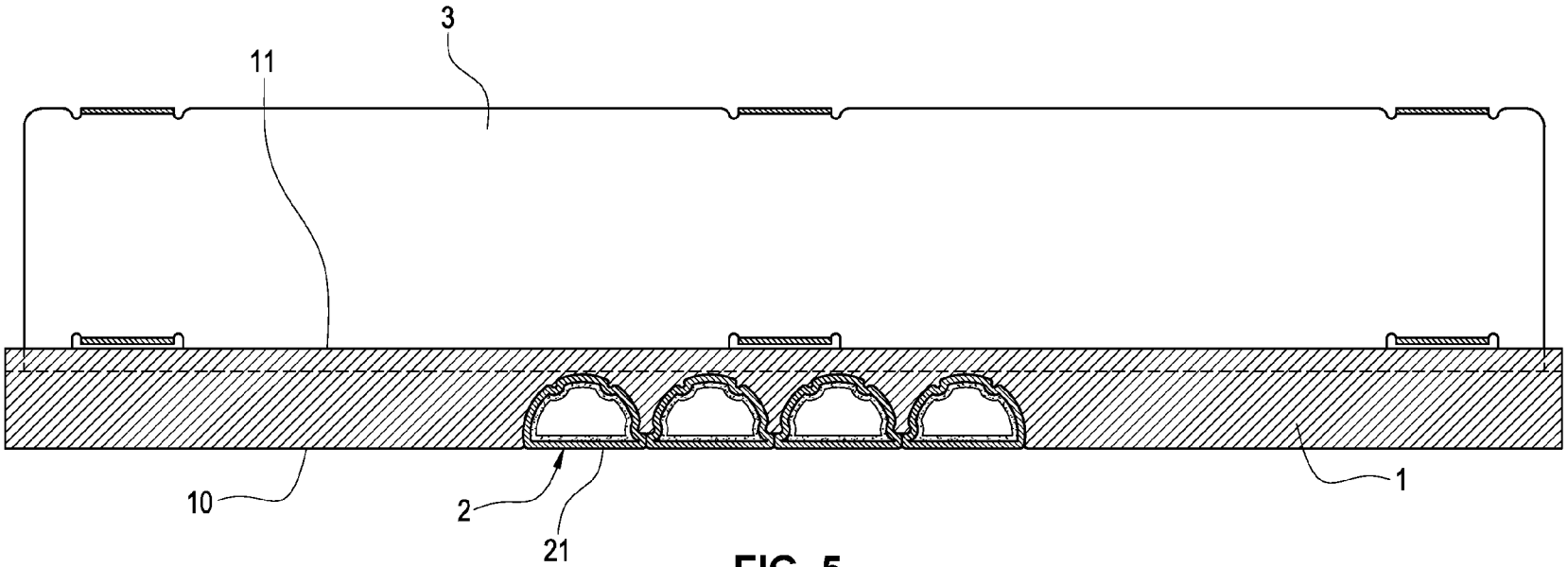
FIG. 5 is a plain view of a heat sink in accordance with the instant disclosure.
Figure 6:
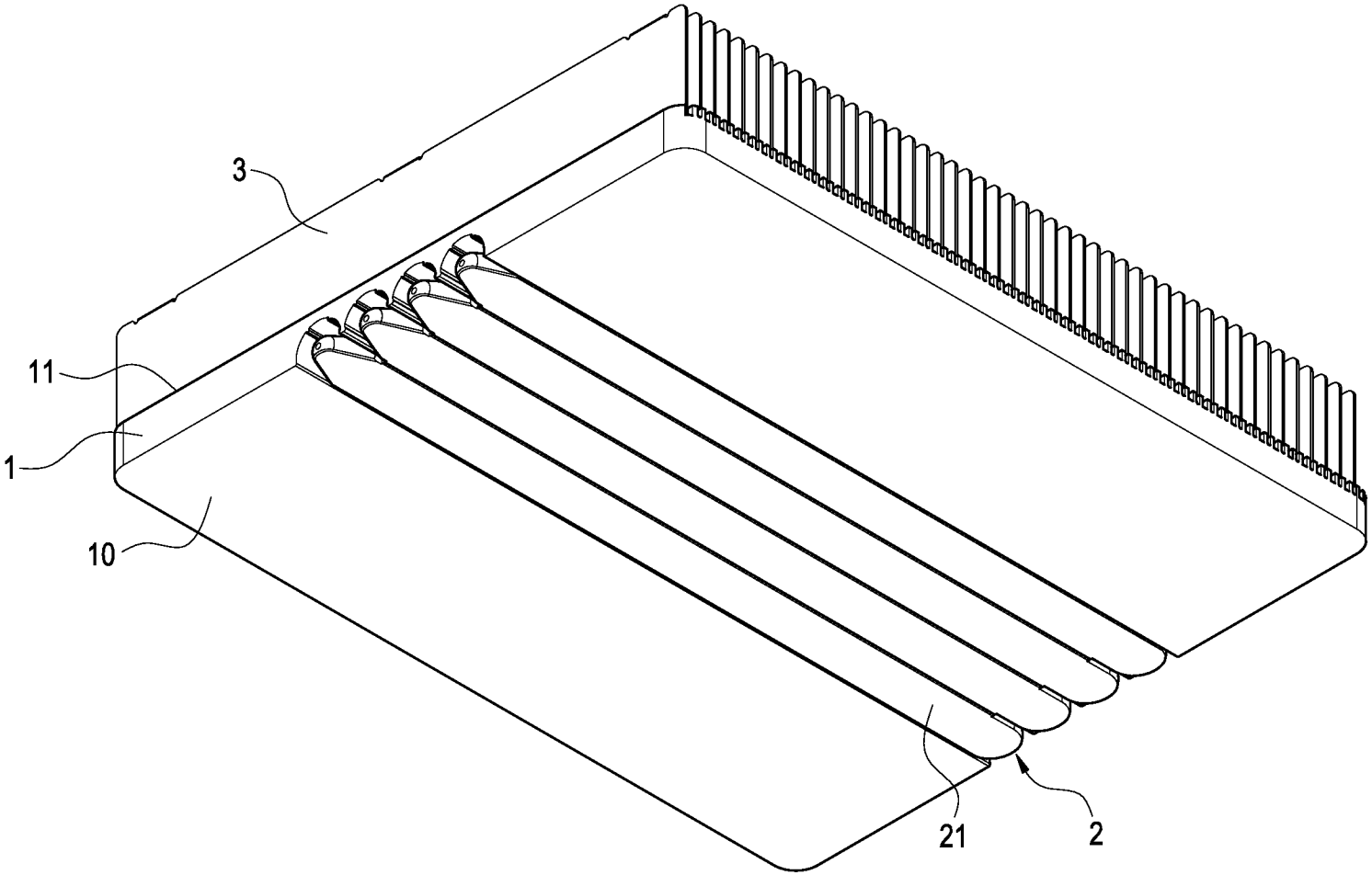
FIG. 6 is a perspective view of the heat sink of the instant disclosure.
Figure 7:
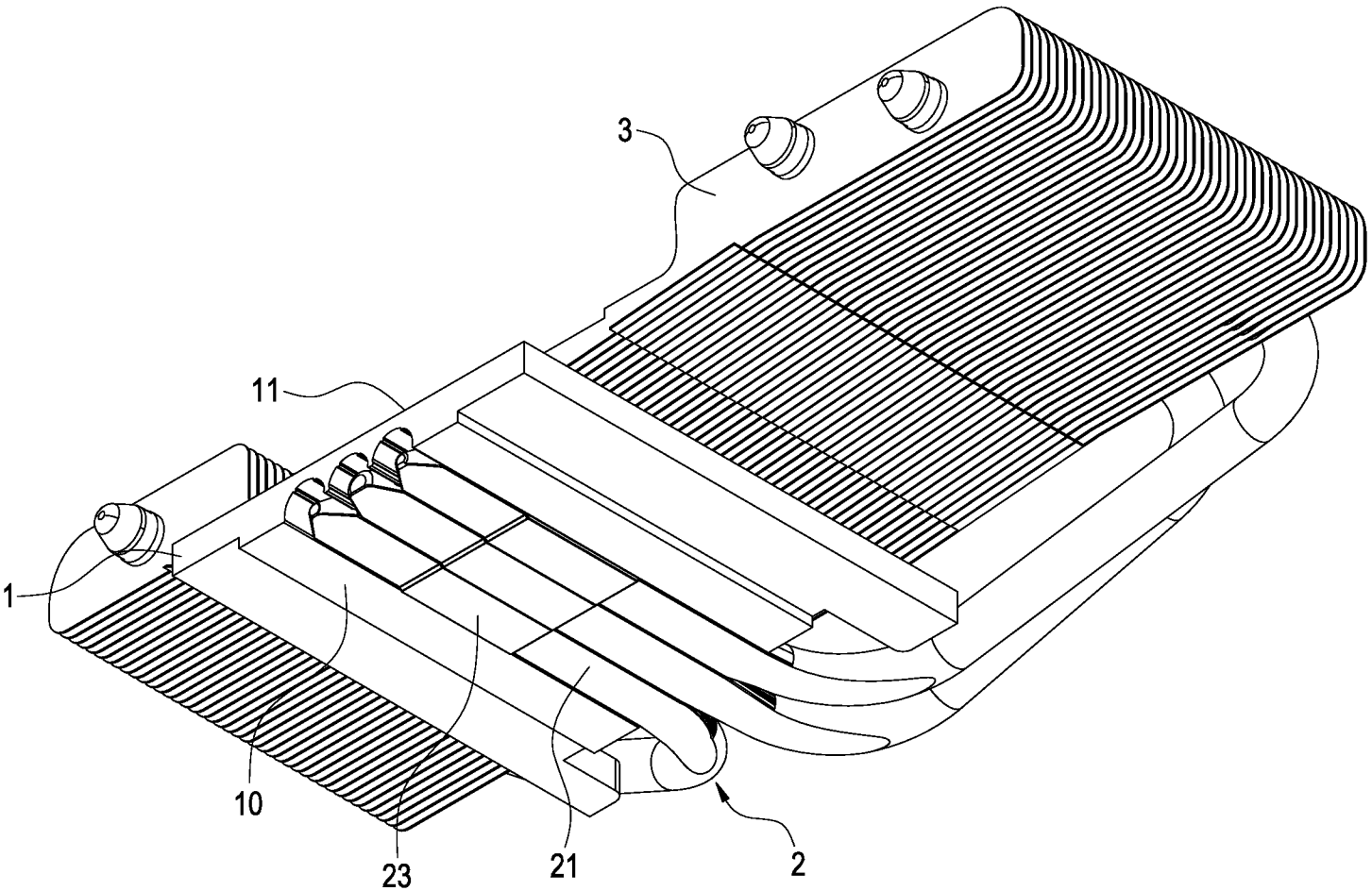
FIG. 7 is a perspective view of a heat sink of another embodiment in accordance with the instant disclosure.

As shown in FIGS. 5 and 6, based on the steps above, the heat pipe assembly of the instant disclosure is obtained. Furthermore, a top surface 11 can be formed on the heat-transfer block 1 opposite to the bottom surface 10. For the instant embodiment, a plurality of heat-dissipating fins 3 can be further disposed onto the top surface 11 of the heat-transfer block 1. Thus, a heat sink is formed. In addition, another embodiment of a heat sink of the instant disclosure is illustrated in FIG. 7. According to this embodiment, a protruding block 23 is further disposed on the heat-absorbing surface 21 of each heat pipe 2. These protruding blocks 23 are arranged in parallel for direct contact with the recessed surface area of the heat source (not shown).

In summary, the instant disclosure is able to achieve the pre-determined objectives and resolve issues facing by conventional heat pipe assemblies. The instant disclosure has novelty and non-obviousness in conforming to the requirements for patent application. Therefore, the present patent application is submitted to obtain a patent for protecting the intellectual property right of the inventor.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A heat pipe mounting method, comprising the steps of:
   a) providing a heat-transfer block and a plurality of heat pipes, a plurality of heat pipe grooves each having a bottom surface being formed on the heat-transfer block for each groove to respectively accommodate one of the plurality of heat pipes, a supporting rib being formed between every adjacent two of the heat pipe grooves, a tip portion being formed on each of the supporting ribs;
   b) press-fitting the heat pipes into the respective heat pipe grooves; and
   c) flattening a part of each of the heat pipes to force the flattened parts of the heat pipes into abutment against one another in a flushed-manner when press-fitting the heat pipes into respective heat pipe grooves, wherein the flattened part of each of the heat pipes extends along and over the tip portion of each of the adjacent supporting ribs, so that the flattened parts of the heat pipes are exposed for heat dissipation and coplanar and in direct contact with each other to form a single flat heat-absorbing surface, with the tip portions of the supporting ribs totally covered thereby.

2. The heat pipe mounting method as claimed in claim 1, wherein a protrusion is formed on the tip portion of each of the supporting ribs toward one of the two adjacent heat pipe grooves in step a).

3. The heat pipe mounting method as claimed in claim 1, wherein a protrusion is formed on the tip portion of each of the supporting ribs toward each of the two adjacent heat pipe grooves in step a).

4. The heat pipe mounting method as claimed in claim 1, 2 or 3, wherein at least one fixing rib is formed on and protruding from each of the heat pipe grooves in step a).

* * * * *